US007895945B2

(12) United States Patent
Probian

(10) Patent No.: US 7,895,945 B2
(45) Date of Patent: Mar. 1, 2011

(54) METHOD FOR IMAGING PRINTING FORMS

(75) Inventor: Dirk Probian, Gablingen/Luetzelburg (DE)

(73) Assignee: Man Roland Druckmaschinen AG, Augsburg (DE)

( * ) Notice: Subject to any disclaimer, the term of this patent is extended or adjusted under 35 U.S.C. 154(b) by 823 days.

(21) Appl. No.: 11/528,129

(22) Filed: Sep. 27, 2006

(65) Prior Publication Data

US 2007/0068411 A1 Mar. 29, 2007

(30) Foreign Application Priority Data

Sep. 28, 2005 (DE) ..... 10 2005 046 242

(51) Int. Cl.
*B41N 1/08* (2006.01)

(52) U.S. Cl. ..... 101/467; 101/401.1; 101/456; 430/272.1

(58) Field of Classification Search ..... 101/478, 101/467, 401.1; 430/272.1
See application file for complete search history.

(56) References Cited

U.S. PATENT DOCUMENTS

| | | | | |
|---|---|---|---|---|
| 6,723,491 | B2 * | 4/2004 | Hannoch | 430/272.1 |
| 6,782,823 | B1 | 8/2004 | Jentzsch | |
| 2002/0003567 | A1 | 1/2002 | Hartmann | |

FOREIGN PATENT DOCUMENTS

| | | | |
|---|---|---|---|
| DE | 100 23 319 | A1 | 11/2001 |
| DE | 100 39 817 | A1 | 2/2002 |
| DE | 102 17 172 | A1 | 10/2003 |
| DE | 601 02 820 | T2 | 9/2004 |
| EP | 0 503 621 | A1 | 9/1992 |
| EP | 1 160 082 | A2 | 12/2001 |
| EP | 1 354 700 | A2 | 10/2003 |
| WO | WO 02/02346 | A3 | 1/2002 |

OTHER PUBLICATIONS

Helmut Kipphan, "Handbuch der Printmedien", 2000, pp. 674-680, Springer-Verlag.
"Handbuch der Printmedien [Printing Media Manual]", Helmut Kipphan, pp. 604-611(w/English translation thereof).

* cited by examiner

*Primary Examiner*—Judy Nguyen
*Assistant Examiner*—Shema T Freeman
(74) *Attorney, Agent, or Firm*—Crowell & Moring LLP

(57) ABSTRACT

A method for imaging a printing form, in particular within a press, is disclosed. A printing form having a rewritable surface being provided, and an imaging material being applied to the surface of the printing form in order to provide a permanent and erasable image. During imaging, in a first step the imaging material is sprayed onto the surface with a relatively low resolution in an image data-oriented manner, and in a second step the imaging material sprayed onto the surface being exposed on the surface with a relatively high resolution in an image data-oriented manner.

19 Claims, No Drawings

METHOD FOR IMAGING PRINTING FORMS

This application claims the priority of German Patent Document No. 10 2005 046 242.1, filed Sep. 28, 2005, the disclosure of which is expressly incorporated by reference herein.

BACKGROUND AND SUMMARY OF THE INVENTION

The invention relates to a method for imaging rewritable printing forms.

During printing with a printing form, in principle a distinction is drawn between printing processes which operate either with a printing form which can be written once or with a rewritable printing form. Printing processes which use rewritable printing forms are also summarized under the keyword "computer to press/direct imaging". The present invention relates to a method for producing a permanent and erasable image on such a rewritable printing form, that is to say a method for imaging rewritable printing forms.

Under the product designation "DICOweb", the applicant markets digital presses which operate with rewritable and erasable printing forms. During the production of a permanent and erasable image on such a rewritable printing form, a basic printing form cylinder is preferably subjected to an erasure step and an imaging step. Imaging of the printing form is possibly followed by fixing and conditioning of the imaged printing form. The basic principles of the DICOweb technology are known from "Handbuch der Printmedien" [Printing Media Manual], Helmut Kipphan, pages 674-680, 2000, Springer-Verlag.

According to the prior art, in order to image a rewritable and erasable printing form, the procedure is such that an imaging material in the form of a transfer ribbon is provided, the imaging material being transferred from the transfer ribbon to the surface of the printing form to be imaged with the aid of a laser. A thermal transfer ribbon of this type is known, for example, from German Patent Document No. DE 100 23 319 A1. According to this prior art, the thermal transfer ribbon is provided in a cassette and, during the imaging of the printing form, is unwound from the cassette, imaging material being transferred from the transfer ribbon to the surface of the printing form to be imaged only when this is necessary in order to image the printing form. Therefore, depending on the printing image, a relatively large amount of imaging material remains on the thermal transfer ribbon, but this cannot be reused.

Taking this as its starting point, the present invention is based on the problem of providing a novel type of method for imaging rewritable printing forms.

This problem is solved by a method for imaging rewritable printing forms. According to the invention, during imaging, in a first step the imaging material is sprayed onto the surface with a relatively low resolution on the basis of image data, in a second step the imaging material sprayed onto the surface being exposed on the surface with a relatively high resolution on the basis of image data.

In the spirit of the present invention, two-stage imaging of a rewritable printing form is provided, in a first step the imaging material being sprayed onto the surface of the printing form with a relatively low resolution on the basis of image data or in an image data-oriented manner, and in a second step the imaging material sprayed on being exposed with a relatively high resolution on the basis of image data or in an image data-oriented manner. Only the exposed imaging material remains on the surface of the printing form; the unexposed imaging material is removed from the printing form before the printing process.

With the aid of the method according to the invention, the imaging material is applied to the surface of the printing form in a specific and metered manner, so that, as compared with the prior art, imaging material can be saved. This material saving results in a cost reduction. Since the imaging material is sprayed onto the surface in a relatively low resolution on the basis of image data or in an image data-oriented manner, spraying within a relatively short time interval is possible.

According to a preferred development of the invention, in the first step the imaging material is sprayed onto the surface of the printing form to be imaged in an image data-oriented manner in an inkjet process, the resolution of the image data-oriented spraying being lower than the resolution of the printing image to be printed, and in the second step the imaging material applied being exposed by a laser in an image data-oriented manner, the resolution of the laser exposure corresponding to the resolution of the printing image to be printed.

Preferred developments of the invention emerge from the following description. An exemplary embodiment of the invention, without being restricted thereto, is explained in more detail below.

DETAILED DESCRIPTION OF AN EXEMPLARY EMBODIMENT

The present invention relates to a method for producing a permanent and erasable image on the surface of a rewritable and erasable printing form, the method preferably being carried out within a press. The method according to the invention can also be carried out outside a press. The method according to the invention can be applied both in the case of rewritable printing plates and in the case of rewritable printing sleeves.

To produce the printing form with a permanent and erasable image, a printing form is provided and, if appropriate, previously subjected to an erasure step in the region of its surface, imaging of the surface of the printing form being carried out after the erasure by an imaging material, in particular polymer-like imaging material, being applied to the surface of the printing form.

In the spirit of the present invention, during imaging, in a first step the imaging material is sprayed onto the surface of the printing form in an image data-oriented manner, preferably with the aid of an inkjet process. The imaging material is sprayed onto the surface of the printing form with a relatively low resolution, which is lower than the resolution of the printing image to be printed. To this end, printing image data present in a high resolution are used to generate low-resolution data by screening or filtering, the spraying of the imaging material being carried out on the basis of these generated low-resolution data.

In a second imaging step, the imaging material sprayed onto the surface is exposed in an image data-oriented manner, preferably with the effect of a laser exposure process, this exposure, just like the spraying of the imaging material, being carried out in an image data-oriented manner but, as distinct from the spraying of the imaging material, with a relatively high resolution, which preferably corresponds to the resolution of the printing image to be printed. Unexposed imaging material is removed from the surface of the printing form, in particular with the effect of a cleaning process using a damping solution and a cleaning cloth.

In the spirit of the present invention, it is accordingly provided to carry out the imaging of a rewritable and erasable printing form in two steps, in the first step imaging material being sprayed onto the surface of the printing form in an image data-oriented manner and, in a second step, the imaging material sprayed on being exposed in an image data-oriented manner. The spraying of the imaging material is carried out with a relatively low resolution, the exposure of the same with a relatively high resolution.

According to an advantageous embodiment of the invention, both the image data-oriented spraying of the imaging material onto the surface of the printing form and the image data-oriented exposure of the imaging material are carried out in a traversing manner, that is to say with an offset in space and time. To this end, appropriate devices, specifically a spraying device and an exposure device, are positioned on a crossmember, during imaging the devices being moved past a printing form in the axial direction thereof in a translatory manner with the printing form driven in rotation. In this case, sections of the surface of the printing form to be imaged are successively sprayed with imaging material and then exposed. By means of such parallelization, first of all space can be saved, secondly the time needed for the imaging can be reduced.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A method for imaging a printing form, in particular within a press, a printing form having a rewritable surface being provided, and an imaging material being applied to the surface of the printing form in order to provide a permanent and erasable image, wherein, during imaging, in a first step the imaging material is sprayed onto the surface with a low resolution in an image data-oriented manner, and in a second step the imaging material sprayed onto the surface being exposed on the surface with a high resolution in an image data-oriented manner, wherein in order to carry out the image data-oriented spraying of the imaging material, printing image data present in a high resolution are screened or filtered to generate lower-resolution data, the spraying of the imaging material being carried out on a basis of the lower-resolution data.

2. The method according to claim 1, wherein in the first step the resolution of the image data-oriented spraying of the imaging material is lower than a resolution of the printing image to be printed.

3. The method according to claim 1, wherein in the first step the imaging material is sprayed onto the surface in an inkjet process.

4. The method according to claim 1, wherein in the second step the resolution of the exposure has a substantially same resolution as a resolution of the printing image to be printed.

5. The method according to claim 1, wherein in the second step the exposure of the imaging material is carried out in a laser exposure process.

6. The method according to claim 1, wherein the image data-oriented spraying of the imaging material onto the surface and the image data-oriented exposure of the imaging material on the surface are carried out in a traversing manner, wherein a spraying device and an exposure device arranged on a crossmember are moved past the printing form in an axial direction thereof in a translatory manner with the printing form rotating.

7. The method according to claim 6, wherein the image data-oriented spraying of the imaging material onto the surface and the image data-oriented exposure of the imaging material on the surface are carried out with an offset in space and time.

8. The method according to claim 1, wherein unexposed imaging material is removed from the surface of the printing form.

9. A method for imaging a rewritable and erasable printing form, comprising the steps of:

spraying an imaging material onto a surface of the printing form based on image data with a low resolution; and exposing the sprayed imaging material based on image data with a high resolution.

10. The method according to claim 9, wherein the low resolution is lower than a resolution of a printing image to be printed by the printing form and wherein the high resolution has a substantially same resolution as the resolution of the printing image to be printed by the printing form.

11. The method according to claim 9, further comprising the step of removing unexposed imaging material from the surface of the printing form.

12. The method according to claim 9, wherein the spraying is performed by an inkjet spraying device.

13. The method according to claim 9, wherein the exposing is performed by a laser exposure device.

14. The method according to claim 9, wherein the image data with the low resolution is generated from high resolution printing image data.

15. A method for imaging a rewritable and erasable printing form, comprising the steps of:

spraying an imaging material onto a surface of the printing form based on image data with a low resolution by moving a spraying device in an axial direction of the printing form; and exposing the sprayed imaging material based on image data with a high resolution by moving an exposing device in the axial direction of the printing form.

16. The method according to claim 15, further comprising the step of rotating the printing form.

17. The method according to claim 15, further comprising the step of successively spraying sections of the surface of the printing form prior to the step of exposing.

18. The method according to claim 15, wherein the low resolution is lower than a resolution of a printing image to be printed by the printing form and wherein the high resolution has a substantially same resolution as the resolution of the printing image to be printed by the printing form.

19. The method according to claim 15, further comprising the step of removing unexposed imaging material from the surface of the printing form.

* * * * *